United States Patent [19]

White

[11] Patent Number: 4,559,729

[45] Date of Patent: Dec. 24, 1985

[54] CONTAINER HAVING PRIZE INDICIA ON THE INTERIOR THEREOF

[75] Inventor: Roger B. White, Atlanta, Ga.

[73] Assignee: The Continental Group, Inc., Stamford, Conn.

[21] Appl. No.: 320,642

[22] Filed: Nov. 12, 1981

[51] Int. Cl.[4] ..... B65D 1/12; B65D 41/44; G09F 23/00

[52] U.S. Cl. ..... 40/306; 40/310; 220/1 BC; 283/1 R

[58] Field of Search ..... 283/56, 1 R; 40/306, 40/307, 2 R, 310, 311, 312, 324; 220/1 BC, 269

[56] References Cited

U.S. PATENT DOCUMENTS

| | | | |
|---|---|---|---|
| 541,734 | 6/1895 | Freeman | 40/310 |
| 594,242 | 11/1897 | Freeman | 40/310 |
| 635,098 | 10/1899 | Henckel | 40/310 |
| 716,759 | 12/1902 | Richardson | 40/310 |
| 1,342,223 | 6/1920 | Nakamura . | |
| 1,673,199 | 6/1928 | Merrill . | |
| 1,842,987 | 1/1932 | Kishida | 40/310 |
| 1,982,282 | 11/1934 | Bock | 40/310 |
| 2,143,508 | 1/1939 | Collens | 40/310 |
| 2,580,305 | 12/1951 | Kremer | 40/310 |
| 2,984,035 | 5/1961 | Nalle, Jr. . | |
| 3,958,354 | 5/1976 | Hough et al. | 40/307 |
| 4,027,426 | 6/1977 | Wallding et al. | 40/310 |
| 4,115,939 | 9/1978 | Marks | 40/310 |
| 4,203,240 | 5/1980 | Goodwin | 40/310 |
| 4,266,688 | 5/1981 | Reid | 220/269 |
| 4,322,016 | 3/1982 | Barrash | 40/307 |

*Primary Examiner*—Paul J. Hirsch
*Attorney, Agent, or Firm*—Charles E. Brown

[57] ABSTRACT

A two-piece can having a prize indicia imprinted on the interior thereof, the can having an openable segment to provide a pour hole for the contents which, upon being emptied from the can, is visible through the pour hole.

8 Claims, 4 Drawing Figures

CONTAINER HAVING PRIZE INDICIA ON THE INTERIOR THEREOF

BACKGROUND OF THE INVENTION

In order to stimulate the purchase of their products, manufacturers have developed various programs of prizes. In the sale of beverages, the practice has been to imprint a concealed the prize value under the cap or crown so that the purchaser is required to open the bottle before gaining access to the prize information, if any. Purveyors of soft drinks in three-piece cans have heretofore concealed legends on the interiors of the end members which, when after the product is consumed, are visible through the pour opening.

DISCUSSION OF THE PROBLEM

Several serious problems have arisen in connection with the security of such programs. Complaints have been increasing of tampering of the product by the customers, employees and others. The cap or crown would be lifted and either reapplied or discarded. The small cap is easily concealable by the thief on his person and the integrity of the program is very difficult to monitor. In three-piece cans, the small prize-indicating end members must be guarded to prevent theft.

SOLUTION OF THE PROBLEM

In order to prevent the vandalism and tampering described and to maximize security for the indicia of prize, the invention provides imprinting the indicia on the interior of the bottom of a two-piece can which has a top seamed to the can body and in which the top is preferably provided with an openable segment of the type which, once opened, provides a pouring hole for the beverage and cannot be reclosed. The beverage must be emptied from the container either by drinking or pouring into another vessel before the prize imprint, which is marked by jet marking apparatus extending the length of the container and jet sprays the interior of the integral bottom, is visible through the pouring hole. Furthermore, to qualify as genuine, the can must be coded by the beverage filler. Thus an almost foolproof arrangement has been provided to secure the prizes to the intended recipients.

The foregoing advantages and other objects of the invention will become more apparent from the specification and the drawings, wherein.

DESCRIPTION OF THE INVENTION

Figure 1:
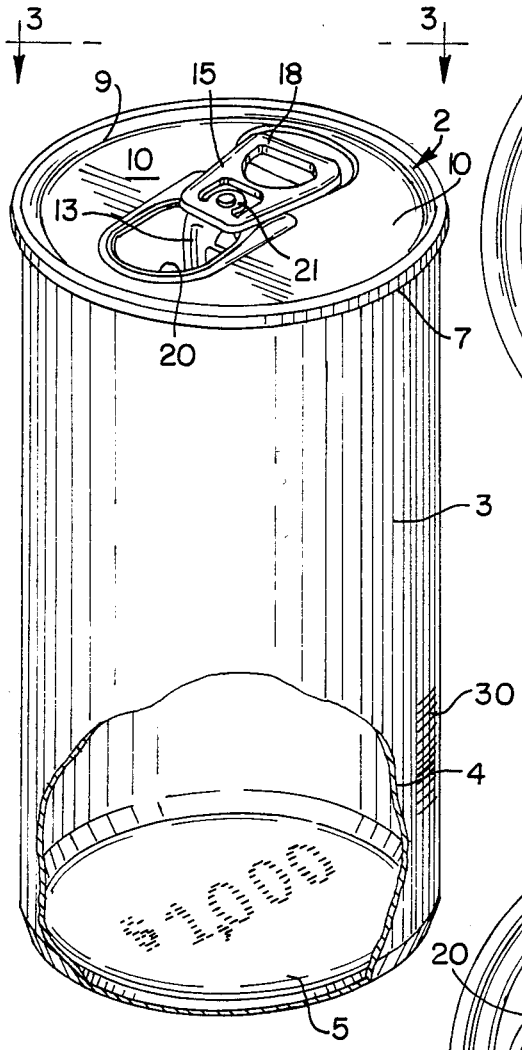
FIG. 1 is a perspective view of a container partly broken away incorporating the invention.
Figure 2:
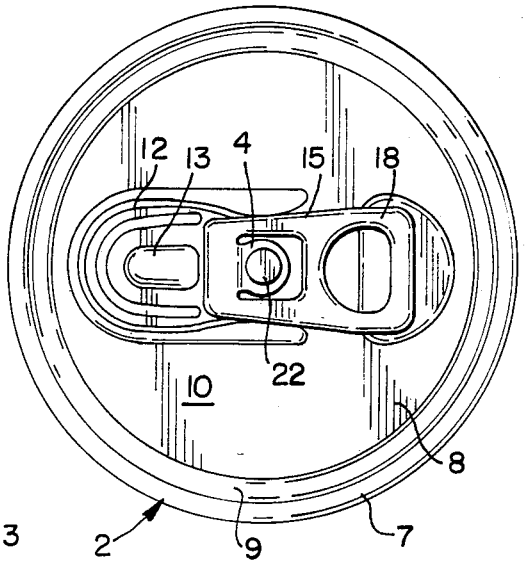
FIG. 2 is a top plan view of the container shown closed.
Figure 3:
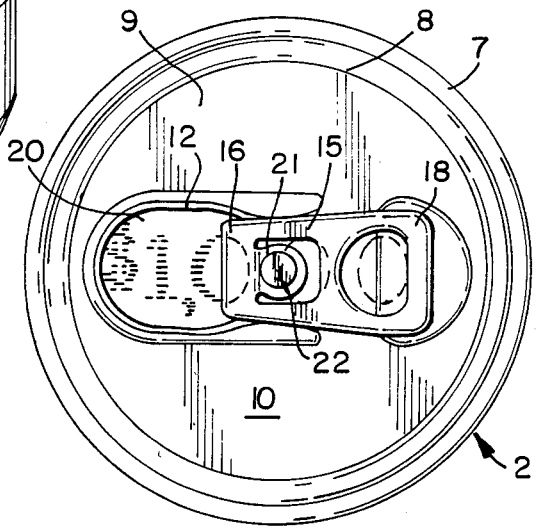
FIG. 3 is a top plan view of the container taken on line 3—3 of FIG. 1.
Figure 4:
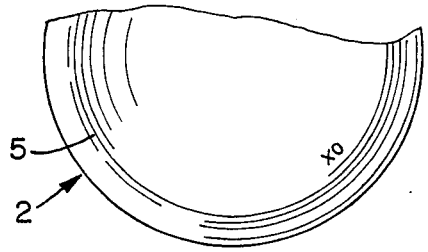
FIG. 4 is a fragmentary bottom view of the container.

The invention is incorporated in a can generally designated 2 comprising a body 3 having a side wall 4 and an integral bottom 5. The top end of the body wall 4 is double seamed at 7 in conventional manner to an end member 8 which has a peripheral chuck wall 9 and a center panel 10.

The panel 10 is suitably scored at 12 to define an openable segment 13 which is adapted to be opened by a tab 15.

The tab 15 is in the form of an elongated lever having a nose portion 16 at one end overlapping a minor portion of the segment 13 and a handle portion 18 at its other end adapted to be lifted to press the nose portion against the segment 13 and break the score and push the segment 13 into the can leaving a pour opening 20. The tab has an ear 21 intermediate its ends attached to the nose at one end and at the other end being attached by a rivet 22 to the can end or top.

Upon opening the can, the contents may be consumed by the person. After the can is empty, the consumer may readily look through the opening 20 into the can wherein on the interior of the bottom thereof, he can see if he won a prize. As seen in the drawings, a prize indicia of $1,000 has been printed on the bottom in line of sight through the opening 20, whereupon the lucky winner can return the can and redeem the prize. Such prize indicia may be in any form such as a pictorial representation of the prize, a word or a code.

It will be noted that the printed prize amount will be coated with the usual FDA approved transparent coating to prevent its obliteration or contamination of the contents.

Also, the can is imprinted as at 30 with the product code and a manufacturer's code such as XO is printed on the exterior of the bottom which authenticates the container.

Of course, the body will be imprinted on the inside of the bottom prior to closing the top.

Although the drawings illustrate the prize indicia to be on the bottom, such indicia can be imprinted on the side of the container and the container may be a bottle, either glass or plastic, or a food can. Glass bottles in many instances already have a foam sleeve overwrap and many plastic bottles have a dark bottom end. Of course, the color of the indicia could be blended to match the color of the product so that it would not be visible through glass or plastic.

The interior of the bottom of the two-piece can is imprinted by inserting a jet inker into the can open top before the end member is seamed to the body. The marked can is inserted by a trusted employee into the filling line which is then lost to the workers since it is automatically filled and closed.

Having described the preferred embodiment of the invention, it will be apparent that various modifications may be considered which come within the scope of the appended claims.

I claim:

1. In combination with a container having a body wall and an integral bottom end, a top end connected to the body and having an integral non-reclosable opening section and means securely connected to said openable section for opening said section to provide a pour opening therein, and a prize indicia separately formed on the surface of the interior of said bottom end in a position only visible through said pour opening and only after the disposal of the contents of said container.

2. The invention according to claim 1 wherein container is a can and said bottom has a convex interior.

3. The invention according to claim 1 and wherein said indicia is imprinted on said bottom wall and a transparent coating is applied thereover.

4. A purchase-stimulating package comprising a container including a body and an integral end and having a prize-indicating means separately formed on the interior surface thereof, said prize-indicating means being invisible from the exterior of the container when filled, means for opening said container to provide a discharge opening in line of sight to said prize-indicating means whereby upon discharge of the contents from the container, said prize indicating means is visible through said opening only.

5. The invention according to claim 4 and said container comprising top and bottom ends, and said means for opening said container comprising a non-reclosable openable segment located on said top end, and said prize-indicating means being located on said bottom end.

6. The invention according to claim 4 and said prize-indicating means comprising an imprint and a product-isolating coating on the interior of said container covering said prize-indicating imprint.

7. The invention according to claim 6 and further authenticating means provided elsewhere on the container.

8. The invention according to claim 7 and said further authenticating means disposed on the exterior of the bottom end of the container.

* * * * *